US006121879A

United States Patent [19]

Lian et al.

[11] Patent Number: 6,121,879

[45] Date of Patent: Sep. 19, 2000

[54] DEACTIVATION ELEMENT CONFIGURATION FOR MICROWAVE-MAGNETIC EAS MARKER

[75] Inventors: Ming-Ren Lian, Boca Raton; Larry Burgess, Lighthouse Point, both of Fla.

[73] Assignee: Sensormatic Electronics Corporation, Boca Raton, Fla.

[21] Appl. No.: 09/219,921

[22] Filed: Dec. 23, 1998

[51] Int. Cl.[7] ..... G08B 13/24

[52] U.S. Cl. ..... 340/572.3; 340/551; 340/572.1; 340/572.3

[58] Field of Search ..... 340/551, 572.1, 340/572.2, 572.3

[56] References Cited

U.S. PATENT DOCUMENTS

| | | | |
|---|---|---|---|
| Re. 32,427 | 5/1987 | Gregor et al. | 340/572.3 |
| 3,747,086 | 7/1973 | Peterson | 340/572.3 |
| 4,158,434 | 6/1979 | Peterson | 235/382 |
| 4,413,254 | 11/1983 | Pinneo et al. | 340/572.3 |
| 4,568,921 | 2/1986 | Pokalsky | 340/572.3 |
| 4,622,543 | 11/1986 | Anderson, III et al. | 340/572.3 |
| 4,642,640 | 2/1987 | Woolsey et al. | 342/42 |
| 4,736,207 | 4/1988 | Siikarla et al. | 343/895 |
| 5,121,106 | 6/1992 | Kataria et al. | 340/572.3 |
| 5,341,125 | 8/1994 | Plonsky et al. | 340/572.3 |

*Primary Examiner*—Glen Swann
*Attorney, Agent, or Firm*—Robin, Blecker & Daley

[57] ABSTRACT

An EAS marker for use in a microwave-GMI article surveillance system includes a length of wire which exhibits a giant magneto-impedance effect, and deactivation elements installed along the length of the wire. The deactivation elements exhibit semi-hard ferromagnetic properties and have a triangular profile, or alternatively exhibit acute-angle corners or have edges that cross the wire at acute angles. The deactivation elements can be magnetized to disable the marker.

21 Claims, 3 Drawing Sheets

DEACTIVATION ELEMENT CONFIGURATION FOR MICROWAVE-MAGNETIC EAS MARKER

FIELD OF THE INVENTION

This invention relates to electronic article surveillance (EAS) systems, and more particularly to markers for use with such systems.

BACKGROUND OF THE INVENTION

It is well known to provide electronic article surveillance systems to prevent or deter theft of merchandise from retail establishments. In a typical system, markers designed to interact with an electromagnetic field placed at the store exit are secured to articles of merchandise. If a marker is brought into the field or "interrogation zone", the presence of the marker is detected and an alarm is generated. Some EAS markers are intended to be removed at the checkout counter upon payment for the merchandise. Other types of markers remain attached to the merchandise but are deactivated upon checkout by a deactivation device which changes a characteristic of the marker so that the marker will no longer be detectable at the interrogation zone.

An EAS system has been proposed which includes an application of the so-called "giant magneto-impedance" (GMI) effect. The GMI effect is a phenomenon in which the voltage induced by a high frequency current source in a ferromagnetic wire is substantially changed by applying an external DC magnetic field to the wire.

An EAS system according to this proposal is somewhat schematically illustrated in FIGS. 1 and 2. The system shown in FIGS. 1 and 2 includes pedestals 10 and 11, disposed on opposite sides of a doorway 12. The pedestals are arranged to provide an alarm signal whenever a marker 13 attached to a garment 14 is brought within range, provided, of course, that the marker 13 is in an activated condition.

The marker, to be described hereinafter, includes a wire (not shown in FIGS. 1 and 2) which exhibits the abovementioned GMI effect. One or both of the pedestals include respective antennas which transmit into an interrogation zone at the doorway 12 a microwave carrier signal, and a relatively low frequency alternating magnetic field. The active wire component of the marker 13 is preferably cut to a length equal to half the wavelength of the microwave carrier signal. The wire is therefore able to efficiently receive and re-emit the microwave energy. The low frequency magnetic field, if incident along the length of the wire, modulates the effective impedance of the wire at the frequency of the magnetic field signal. This produces a side band signal of the microwave carrier frequency. The resulting signal which is radiated from the marker is quite unique, and can be readily detected by a suitable receiver included in one or both of the pedestals. The interaction between the marker 13 and the pedestals 10, 11 is schematically illustrated in FIG. 2, in which the block captioned "surveillance system" represents the pedestals 10, 11 and the electronic circuitry incorporated therein.

Although the doorway 12 shown in FIG. 1 is relatively narrow, it is believed that an EAS system utilizing the microwave-GMI marker referred to above may operate effectively to cover an interrogation zone having a width of several meters or more.

It could be contemplated to provide a deactivable microwave-GMI marker, for use with the EAS system illustrated in FIGS. 1 and 2, according to a construction which is schematically illustrated in FIG. 3. Element 20 shown in FIG. 3 is the above-mentioned GMI wire, cut to the half-wavelength of the microwave carrier of the EAS system. Deactivation elements 22 are positioned at intervals along the wire 20. (Those of ordinary skill will recognize that the deactivation element configuration shown in FIG. 3 is similar to that employed in a deactivable harmonic-type EAS marker like that shown in U.S. Pat. No. 5,341,125.) As would be expected by those who are skilled in the art, the deactivation elements 22 would be formed of a material having semi-hard ferromagnetic properties.

When it is desired to deactivate the marker, a DC magnetic field would be applied along the length of the wire 20 at a level sufficiently high to magnetize the deactivation elements 22. The resulting bias magnetic fields applied by the deactivation elements 22 to the wire 20 interferes with the GNI effect that would otherwise be caused by the low frequency magnetic interrogation field, so that the sideband modulation of the marker signal does not take place, and the marker is not detectable by the surveillance system 15. However, as deactivation would be carried out in practice in a retail store using conventional deactivation devices, it may be difficult or impossible to assure that the deactivation field to be applied to the deactivation elements 22 is oriented along the length of the wire 20. As the inventors of the present invention have recognized, any misalignment of the deactivation field relative to the length of the wire may fail to magnetize the deactivation elements 22 in such a way that they substantially interfere with the GNI effect. Consequently, a marker having the configuration shown in FIG. 3 is likely not to be reliably deactivated by known practices.

OBJECTS AND SUMMARY OF THE INVENTION

It is accordingly an object of the invention to provide a microwave-GMI electronic article surveillance marker that can be reliably deactivated using conventional marker deactivation devices.

According to an aspect of the invention, there is provided an EAS marker, including an active element for receiving and re-radiating an interrogation signal generated by an EAS system transmitter, the active element having a length extent, and a plurality of control elements (also referred to as "deactivation elements") installed along the length extent of the active element, the control elements being provided to be selectively magnetized to deactivate the marker, and each of the control elements being substantially planar and having a contour in the plane of the element such that the contour includes at least one acute angle.

According to another aspect of the invention, at least some control elements in a marker as described in the previous paragraph have a respective edge positioned to form an acute angle with the longitudinal axis of the active element.

A microwave-GMI marker configured in accordance with the invention can be reliably deactivated, because it is not unduly sensitive to the orientation of the marker relative to the DC magnetic field applied for the purpose of deactivating the marker.

The foregoing, and other objects, features and advantages of the invention will be further understood from the following detailed description of preferred embodiments and from the drawings, wherein like reference numerals identify like components and parts throughout.

DESCRIPTION OF PREFERRED EMBODIMENTS

Preferred embodiments of the invention will now be described with reference to the drawings.

Figure 4:
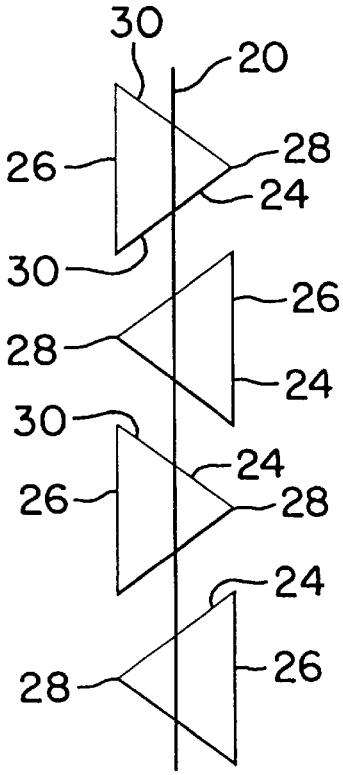
FIGS. 4–9 are schematic plan views showing essential elements of deactivable EAS markers provided in accordance with the present invention.

One preferred embodiment of the invention is schematically illustrated in plan view in FIG. 4. The microwave-GMI marker illustrated in FIG. 4 includes a GMI wire 20 which functions as the active element of the marker. As noted above, the wire 20 should have a length which corresponds to half the wavelength of the microwave carrier signal utilized by the EAS system. For example, the wire may be 6.1 centimeters long, corresponding to a carrier frequency of 2.45 GHz. The diameter of the wire may be, for example, about 120 microns or less.

As has been shown by studies of the GMI phenomenon, the wire should exhibit high permeability and should have a circumferential magnetic anisotropy. A suitable wire may be formed of a material which exhibits a minimal level of negative magnetostriction. Typically the wire would have an amorphous or nanocrystalline structure in order to satisfy the requirement of high permeability. Conventional processes such as casting in rotating water or melt extraction, followed by cutting to a suitable length, could be employed to form the wire 20.

Current annealing may be applied to the material to reduce stress so as to improve the magnetic properties of the material and to establish the circumferential anisotropy. Application of a 0.4 amp current for two minutes was found to be satisfactory when applied to a wire having the composition $(Fe_6Co_{93}Nb_1)_{84}$ $Si_1B_{15}$ and a diameter of 120 microns. It should be understood that the Nb content may be omitted from the metal alloy composition, and a number of other compositions and processes may be employed to produce an active element 20 which exhibits the GMI effect.

Also shown in FIG. 4 are deactivation elements 24 which are positioned at intervals along the length of the wire 20. The deactivation elements 24 are substantially planar, and may be formed by cutting from a sheet of suitable material. The material may be the same as that used to form deactivation segments for the above-mentioned deactivable harmonic-type EAS markers, or any other kind of semi-hard magnetic material. (A material is to be considered "semi-hard" when it has a coercivity in the range of about 10 Oe to about 500 Oe.) Preferably all the elements 24 are arranged in a common plane to minimize the thickness of the marker.

It will be noted from FIG. 4 that the deactivation elements 24 have a triangular profile. The elements 24 may be formed from a sheet that is about 50 microns thick, and the shape of the elements may be that of an isosceles triangle with a base having the same length as the height of the triangle. One convenient size for the elements would be such that the base and height are both 4 mm.

It will be observed from FIG. 4 that each of the elements 24 has an edge 26 which is arranged so as to be spaced from and substantially parallel to the length of the wire 20. Each of the elements 24 has a vertex 28 that is opposite to its respective edge 26 and is positioned on the opposite side of the wire 20 from the edge 26 so that the wire 20 touches the element 24 in between the edge 26 and the vertex 28.

It will further be observed from FIG. 4 that the respective directions of orientation of the vertices 28 are arranged in an alternating manner as one proceeds along the length of the wire 20.

It is noted that the triangular shapes of the deactivation elements 24, like any triangles, include acute angle vertices, including at least one vertex that does not exceed about 60° in angular extent. Also, edges of the deactivation elements 24, which are represented, for example, by edges 30, cross the longitudinal axis of the wire 20 at acute angles.

Figure 1:
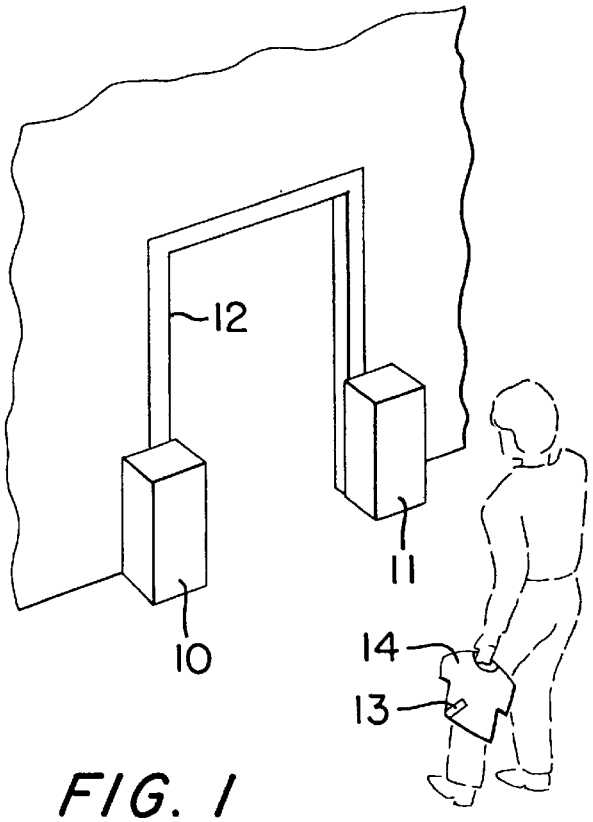
FIG. 1 (PRIOR ART)
FIGS. 1 and 2 schematically illustrate an EAS system provided according to the prior art.
Figure 2:
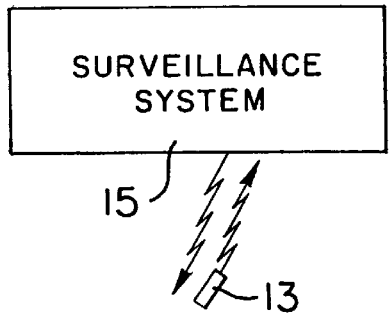
FIG. 2 (PRIOR ART)
Figure 3:
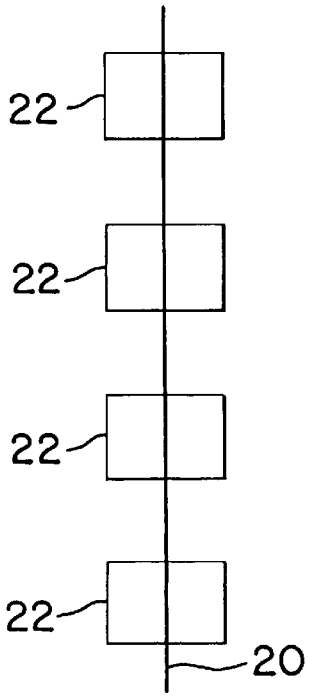
FIG. 3 is a schematic plan view of essential components of a marker that may be used with the EAS system of FIGS. 1 and 2.

The geometric configurations and the arrangement of the deactivation elements 24 relative to the wire 20 are such that the process for deactivating the marker of FIG. 4 is relatively insensitive to the orientation at which the marker is presented for exposure to the DC magnetic field which is applied to magnetize the deactivation elements 24 for the purpose of deactivating the marker. In other words, the control element arrangement shown in FIG. 4 provides for a marker that can be deactivated much more reliably than the marker shown in FIG. 3.

After deactivation, the marker shown in FIG. 4 can be restored to an active condition by degaussing the deactivation elements 24.

Figure 5:
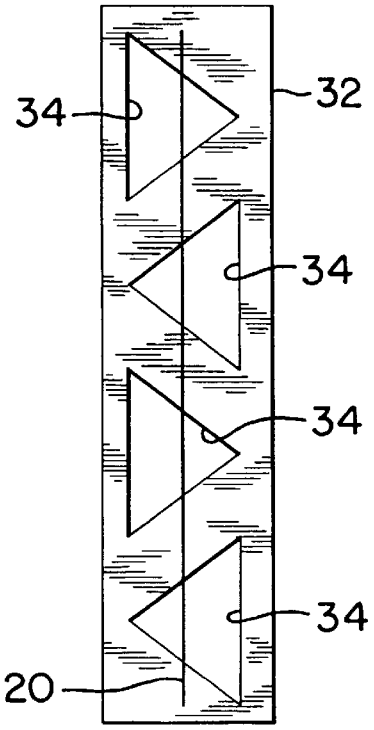

FIG. 5 shows an alternative embodiment of the invention, in which a deactivation member is constituted by a ribbon-shaped strip 32 of semi-hard magnetic material that is installed adjacent and parallel to the GNI wire 20 with regions punched out of the strip 32. In particular, holes 34 are cut out of the strip 32, and either the holes 34 themselves, or the segments of the strip 32 defined between the holes 34, may be considered to constitute deactivation elements. It will be noted that the holes 34 exhibit the same acute-angle vertices as the deactivation elements 24 of FIG. 4. In addition, the holes 34 have edges which cross the longitudinal axis of the wire 20 at acute angles.

Figure 5A:
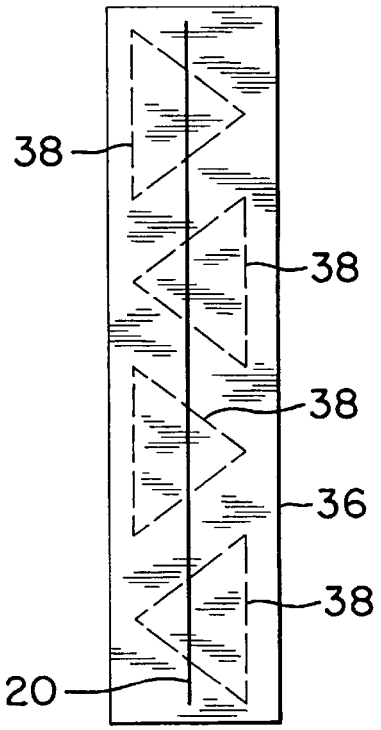

FIG. 5A shows another alternative embodiment of the invention, in which a ribbon-shaped strip 36 of magnetically soft material has been installed adjacent and parallel to the GMI wire 20. The strip 36 has been treated at triangular-shaped regions 38, denoted by dashed lines, by a process such as laser heating, to create magnetic discontinuities at those regions. Consequently, the regions 38 exhibit semi-hard magnetic properties and function as deactivation elements for the marker. It is noted that the regions 38 have the same geometry and placement relative to the wire 20 as the deactivation elements 24 of FIG. 4.

It is to be understood that the deactivation elements need not be triangular in shape. Deactivation elements of other shapes, which have acute angles and/or are arranged relative to the wire with edges of the deactivation elements crossing the wire at acute angles, may be employed without departing from the invention.

Figure 6:
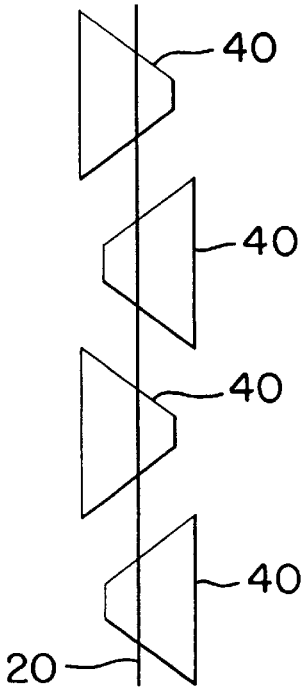
Figure 7:
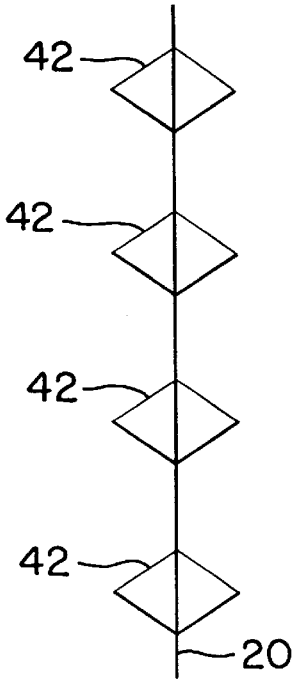

FIGS. 6–9 show further alternative embodiments of the invention. In FIG. 6, deactivation elements 40 having a trapezoid shape are employed. In the embodiment of FIG. 7, the deactivation elements 42 have the shape of an acute-angle rhombus.

Figure 8:
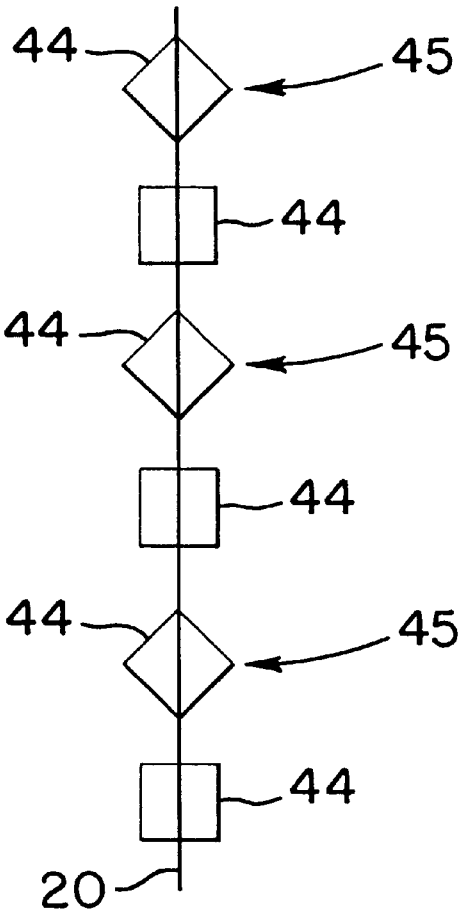

In the embodiment of FIG. 8, the deactivation elements 44 are all square, but the elements positioned at locations 45 are arranged with one of their diagonals aligned with the length of the wire 20, whereas the other elements 44 are arranged with edges parallel to the wire 20.

Figure 9:
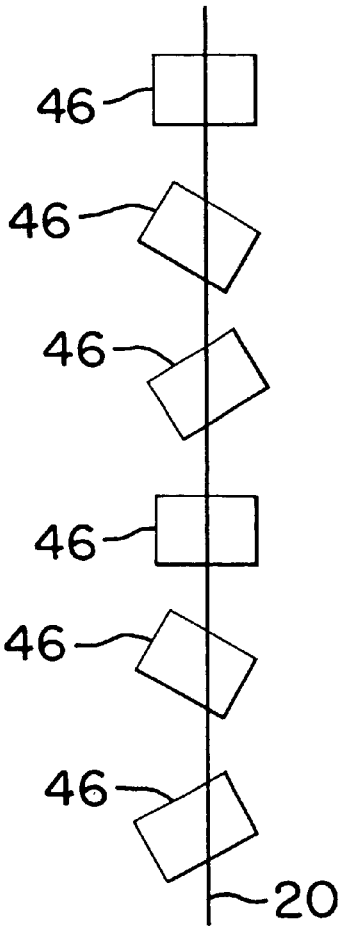

In FIG. 9 all of the deactivation elements 46 have the shape of a non-square rectangle. Some of the elements 46 are positioned with all edges either parallel or perpendicular to the length of the wire 20, but others of the elements 46 are canted with one orientation or another, so that edges of the respective elements cross the length of the wire 20 at acute angles.

Although not shown in the drawings, it should be understood that each of the marker embodiments preferably includes a paper backing or other substrate to permit the marker to be attached by conventional means to the article of merchandise to be protected.

It was noted above that a suitable microwave carrier frequency for the EAS system with which the markers are to be used is 2.45 GHz, which would call for an active element having a length of 6.1 centimeters. However, many other frequencies could be employed as the carrier frequency, so that the length of the marker could also be varied substantially. Many choices are also available in terms of the frequency selected for the modulating magnetic field. Two suitable frequencies are believed to be 1 KHz and 650 Hz.

The microwave transmitter and antenna to be used in the EAS system may be of conventional design. It is also well within the capabilities of those of ordinary skill to provide the circuitry for generating the modulating magnetic field. A suitable antenna to radiate the alternating magnetic field may take the form of a rectangular coil, having dimensions such as 2 feet by 1.5 feet. It is also well within the capabilities of those of ordinary skill to provide receiver circuitry for detecting the sideband signal generated by active markers that are brought into the interrogation zone.

The present invention is directed primarily for application in microwave-GMI markers, but could also be applied to harmonic-type markers. Consequently, the active element 20 may be constituted by a wire of the type which produces high harmonic perturbations of an excitation signal. In this case, conventional interrogation and detection equipment used in harmonic EAS systems would be employed.

Although all of the marker embodiments shown herein are shown as including marker elements that are all of the same shape in the particular embodiment, it should be understood that deactivation elements of a variety of shapes may be used in a single marker.

Various other changes in the foregoing marker embodiments may be introduced without departing from the invention. The particularly preferred embodiments are thus intended in an illustrative and not limiting sense. The true spirit and scope of the invention are set forth in the following claims.

What is claimed is:

1. An EAS marker, comprising:

an active element for receiving and re-radiating an interrogation signal generated by an EAS system transmitter, said active element having a length extent; and a plurality of control elements installed along said length extent of said active element, said control elements for being magnetized to deactivate the EAS marker, each of said control elements being substantially planar and having a contour in its plane such that the contour includes at least one acute angle.

2. An EAS marker according to claim 1, wherein a first one of said control elements has an acute angle oriented in a first direction, and a second one of said control elements has an acute angle oriented in a second direction that is opposite to said first direction.

3. An EAS marker according to claim 1, wherein each of said control elements has a triangular contour.

4. An EAS marker according to claim 1, wherein each of said control elements has an angle that does not exceed about 60° in angular extent.

5. An EAS marker according to claim 1, wherein each of said control elements exhibits semi-hard magnetic properties.

6. An EAS marker according to claim 1, wherein said control elements are defined by holes formed in a strip of magnetic material installed adjacent said active element.

7. An EAS marker according to claim 1, wherein said active element is a wire formed of an amorphous metal alloy.

8. An EAS marker according to claim 7, wherein said wire exhibits a GMI effect.

9. An EAS system, comprising:

interrogation means for generating an interrogation signal;

a marker including an active element for receiving and re-radiating the interrogation signal, the active element having a length extent and the marker further including a plurality of control elements installed along said length extent of said active element, said control elements for being magnetized to deactivate said marker, each of said control elements being substantially planar and having a contour in its plane such that the contour includes at least one acute angle; and detection means for receiving the signal re-radiated by said marker.

10. An EAS system according to claim 9, wherein a first one of said control elements has an acute angle oriented in a first direction, and a second one of said control elements has an acute angle oriented in a second direction that is opposite to said first direction.

11. An EAS system according to claim 9, wherein each of said control elements has a triangular contour.

12. An EAS system according to claim 9, wherein each of said control elements has an angle that does not exceed about 60° in angular extent.

13. An EAS system according to claim 9, wherein each of said control elements exhibits semi-hard magnetic properties.

14. An EAS system according to claim 9, wherein:

said interrogation means includes first means for generating a carrier signal at a first frequency and second means for generating an alternating magnetic field at a second frequency that is lower than said first frequency;

said active element mixes said second frequency with said carrier signal to generate a sideband of said carrier signal; and said detection means detects said sideband generated by said active element.

15. An EAS marker, comprising:

an active element for receiving and re-radiating an interrogation signal generated by an EAS system transmitter, the active element being an elongated strip of magnetic metal alloy which has a longitudinal axis; and a plurality of control elements installed along said active element, said control elements for being magnetized to deactivate the EAS marker, at least some of said control elements having a respective edge positioned to form an acute angle with the longitudinal axis of said active element, and each of said control elements having a triangular contour.

16. An EAS marker according to claim 15, wherein each of said control elements exhibits semi-hard magnetic properties.

17. An EAS marker, comprising:

an active element for receiving and re-radiating an interrogation signal generated by an EAS system transmitter, the active element being an elongated strip of magnetic metal alloy which has a longitudinal axis; and a plurality of control elements installed along said active element, said control elements for being magnetized to deactivate the EAS marker, at least some of said control elements having a respective edge positioned to form an acute angle with the longitudinal axis of said active element, and said control elements being defined by holes formed in a strip of magnetic material installed adjacent said active element.

18. An EAS marker, comprising:

an active element for receiving and re-radiating an interrogation signal generated by an EAS system transmitter, the active element being an elongated strip of magnetic metal alloy which has a longitudinal axis;

a plurality of control elements installed along said active element, said control elements for being magnetized to deactivate the EAS marker, at least some of said control elements having a respective edge positioned to form an acute angle with the longitudinal axis of said active element; and wherein said active element is a wire formed of an amorphous metal alloy and said wire exhibits a GMI effect.

19. An EAS system, comprising:

interrogation means for generating an interrogation signal;

marker including an active element for receiving and re-radiating the interrogation signal, the active element having a length extent and the marker further including a plurality of control elements installed along said length extent of said active element, said control elements for being magnetized to deactivate said marker, each of said control elements being substantially planar, and at least some of said control elements having a respective edge positioned to form an acute angle with the longitudinal axis of said active element, and each of said control elements having a triangular contour; and detection means for receiving the signal radiated by said marker.

20. An EAS system according to claim 19, wherein each of said control elements exhibits semi-hard magnetic properties.

21. An EAS system, comprising:

interrogation means for generating an interrogation signal, said interrogation means includes first means for generating a carrier signal at a first frequency and second means for generating an alternating magnetic field at a second frequency that is lower than said first frequency;

a marker including an active element for receiving and re-radiating the interrogation signal, the active element having a length extent and the marker further including a plurality of control elements installed along said length extent of said active element, said control elements for being magnetized to deactivate said marker, each of said control elements being substantially planar, and at least some of said control elements having a respective edge positioned to form an acute angle with the longitudinal axis of said active element, and said active element mixing said second frequency with said carrier signal to generate a sideband of said carrier signal; and detection means for receiving the signal re-radiated by said marker, said detection means detecting said sideband generated by said active element.

* * * * *

UNITED STATES PATENT AND TRADEMARK OFFICE

CERTIFICATE OF CORRECTION

PATENT NO. : 6,121,879
DATED : September 19, 2000
INVENTOR(S) : Ming-Ren Lian et al.

It is certified that error appears in the above-identified patent and that said Letters Patent is hereby corrected as shown below:

Column 2,
Line 18, delete "GNI effect" and insert -- GMI effect --.
Line 27, delete "GNI effect" and insert -- GMI effect --.

Column 4,
Line 32, delete "GNI wire" and insert -- GMI wire --.

Signed and Sealed this

Eighteenth Day of December, 2001

*Attest:*

*Attesting Officer*

JAMES E. ROGAN
*Director of the United States Patent and Trademark Office*